US006747626B2

(12) United States Patent
Chiang

(10) Patent No.: US 6,747,626 B2
(45) Date of Patent: Jun. 8, 2004

(54) DUAL MODE THIN FILM TRANSISTOR LIQUID CRYSTAL DISPLAY SOURCE DRIVER CIRCUIT

(75) Inventor: Johnson Chiang, Hsin Tien (TW)

(73) Assignee: Texas Instruments Incorporated, Dallas, TX (US)

( * ) Notice: Subject to any disclaimer, the term of this patent is extended or adjusted under 35 U.S.C. 154(b) by 241 days.

(21) Appl. No.: 09/994,946

(22) Filed: Nov. 27, 2001

(65) Prior Publication Data

US 2002/0063674 A1 May 30, 2002

Related U.S. Application Data

(60) Provisional application No. 60/250,523, filed on Nov. 30, 2000.

(51) Int. Cl.[7] ..... G09G 3/36

(52) U.S. Cl. ..... 345/98; 345/100

(58) Field of Search ..... 345/87, 89, 88, 345/92, 90, 98, 99, 100, 103, 204; 349/33, 41, 42, 39

(56) References Cited

U.S. PATENT DOCUMENTS

| | | | | |
|---|---|---|---|---|
| 5,521,611 | A | | 5/1996 | Okada et al. |
| 5,574,475 | A | | 11/1996 | Callahan, Jr. et al. |
| 5,621,426 | A | | 4/1997 | Okada et al. |
| 5,703,617 | A | | 12/1997 | Callahan, Jr. et al. |
| 5,719,591 | A | | 2/1998 | Callahan, Jr. et al. |
| 5,726,676 | A | | 3/1998 | Callahan, Jr. et al. |
| 5,784,041 | A | | 7/1998 | Okada et al. |
| 5,798,742 | A | | 8/1998 | Watatani et al. |
| 6,078,368 | A | | 6/2000 | Ichikawa et al. |
| 6,091,390 | A | | 7/2000 | Sim |
| 6,097,362 | A | | 8/2000 | Kim |
| 6,100,868 | A | | 8/2000 | Jeong et al. |
| 6,107,983 | A | | 8/2000 | Masuda et al. |
| 6,118,421 | A | | 9/2000 | Kawaguchi et al. |
| 6,124,840 | A | | 9/2000 | Kwon |
| 6,469,686 | B1 | * | 10/2002 | Koyama et al. ..... 345/92 |
| 6,525,710 | B1 | * | 2/2003 | Kwon ..... 345/100 |
| 6,603,466 | B1 | * | 8/2003 | Sakaguchi et al. ..... 345/204 |

* cited by examiner

*Primary Examiner*—Chanh Nguyen
(74) *Attorney, Agent, or Firm*—April M. Mosby; Wade James Brady, III; Frederick J. Telecky, Jr.

(57) ABSTRACT

The present invention relates to a source driver circuit (200) for driving a thin film transistor liquid crystal display (TFT-LCD) panel. The source driver circuit (200) provides several different operating modes for the driver to lower the power consumption of a TFT-LCD module while still providing a wide analog voltage range to the liquid crystal display elements. A mode signal (MODE) switches the driver from gray scale to standby mode wherein the internal resistive digital to analog converter (202), decoder/output voltage drivers (210) and output buffer amplifiers (212) are powered down. In addition, only the most significant bit of data corresponding to red, green and blue are transferred to a sample and hold register (206, 208). Output cells (216), substituting for the decoder/output voltage drivers, receive one-bit data from hold registers (208) and provide voltage at the output of the driver circuit (200).

10 Claims, 6 Drawing Sheets

200

204
SHIFTER REGISTER
EIO 1,2
2
CLK
Qi
Qi+1
Qi+2
Qi+3
Qi+4
SERIAL VIDEO
DATA BUS
R[0:5]
G[0:5]
B[0:5]
18
206
SAMPLE REGISTER
3
208
HOLD REGISTER
TP1
HiR
HiG
HiB
Hi+1R
Hi+3G
Hi+3B
Hi+4R
Hi+4G
Hi+4B
OUTPUT CELL
216
214
OUTiR
OUTiG
OUTiB
OUTi+1R
OUTi+3G
OUTi+3B
OUTi+4R
OUTi+4G
OUTi+4B

800

802
EIO 1,2
2
CLK
SHIFTER REGISTER
Qi
Qi+1
Qi+2
Qi+3
Qi+4
SERIAL VIDEO DATA BUS
R[0:5]
G[0:5]
B[0:5]
18
804
SAMPLE REGISTER
18
HOLD REGISTER
TP1
806
HiR HiG HiB Hi+1R Hi+3G Hi+3B Hi+4R Hi+4G Hi+4B
6
LG
807
OUTPUT CELL
808
810
OUTiR OUTiG OUTiB OUTi+1R OUTi+3G OUTi+3B OUTi+4R OUTi+4G OUTi+4B b5
b4
b3
b2
b1
b0
902
LG FOR >32 b5
b4
b3
b2
b1
b0
1002
LG FOR >16

DUAL MODE THIN FILM TRANSISTOR LIQUID CRYSTAL DISPLAY SOURCE DRIVER CIRCUIT

This application claims the benefit of provisional application No. 60/250,523 filed Nov. 30, 2000.

FIELD OF THE INVENTION

The present invention relates to a signal driver circuit for a liquid crystal display (LCD), and, more particularly, to a dual mode thin film transistor liquid crystal display (TFT-LCD) source driver circuit having low power consumption.

BACKGROUND OF THE INVENTION

Due to the increased demands for data, handheld communication and portable electronics equipment, such as radios, cellular and cordless telephones, pagers, personal digital assistants (PDAs) and the like, must display greater amounts of information. Equipment must provide displays which feature visual messages that include graphics and printed information as well as a means to access and manipulate such messages. Accordingly, equipment must provide displays that accommodate text and icon information, as well as graphic and video data. Most circuitry used to implement these and other features expend relatively large amounts of power. As a result, power consumption is a major concern for many handheld communication and portable electronics manufacturers.

Conventional liquid crystal displays (LCDs) provide these features using two sheets of polarizing material having a liquid crystal solution between the two, such that when an electric current passes through the liquid, the crystals align to block or pass light. Each crystal, therefore, acts like a switch, either allowing light to pass or blocking light.

Source driver circuits are commonly employed with liquid crystal displays. The driver circuit typically accepts digital video data as an input and provides an analog voltage output to each particular LCD pixel column. Generally, each column in the LCD must be uniquely addressed by a signal or column driver and given the proper analog voltage in order to achieve the desired transmissivity (i.e., the desired shade of gray or color). Moreover, it is desirable that the output voltage range of a driver circuit be wide to allow for a high pixel contrast ratio.

For color LCDs, each pixel is composed of 3 sub-pixel elements representing the primary colors of red, green and blue. For example, a color VGA panel having a resolution of 640 columns×480 rows of uniquely addressable pixels will have 3×640 columns, or 1920 columns. Typically, the signal driver circuit has one driver output for each column. Thus, controlling an LCD panel requires a large number of driver outputs that consume considerable circuit area and power. Since this large number of circuitry size impacts power consumption, it is desirable to provide stages of operation in which the operation of each driver circuit is suspended.

Conventionally, there are two modes of operation: standby and gray scale mode. There are two types of standby mode where operation of parts of the source driver is suspended. The first type of standby mode powers down all of the internal circuitry with the exception of some input signal detection circuitry. Given this mode, however, the driver provides no output signal. The second type of standby mode powers down some of the internal circuitry during normal operation of the circuit to save power, not altering the overall system behavior. In gray scale mode, a full color display is present at the LCD providing up to 262144 colors.

Since it is common for the communications equipment to remain in standby mode or text mode, where only text or icon display on the panel, it is not necessary to display full color display quality.

An approach to lower power consumption may include the use of a color super-twisted nematic liquid crystal display (STN-LCD). Although this implementation provides the greatest benefit, there exists slow display response time. In addition, using STN-LCD makes it difficult to generate high resolution colors. Both of these problems contribute to the complexity of displaying real time video or graphic information.

Another approach to lower power consumption may include the use of color LCD displays using the thin film transistor (TFT) technology which produce color images that are as sharp as traditional CRT displays. The TFT-LCD is a type of LCD flat-panel display screen, in which each pixel is controlled by one to four transistors. Conventional, TFT-LCDs can provide higher display response time and high resolution colors, but the power consumption is ten times that of STN-LCD. As a further limitation to the TFT-LCD implementation, the light transmission curve shown in FIG. 4 illustrates that the conventional TFT-LCD source driver is useful during a limited range of the voltages.

Thus, there exists a need for a dual mode TFT-LCD source driver circuit having low power consumption that is operable in response to a large range of voltages having at least one type of standby mode where operation of a portion of the driver circuit is suspended to lower power consumption such that the LCD is still capable of providing text, icon, graphic and video information on the display without using the full scale of colors available in the gray scale mode.

SUMMARY OF THE INVENTION

To address the above-discussed deficiencies of the dual mode thin film transistor liquid crystal display source driver circuit, the present invention teaches dual mode thin film transistor liquid crystal display source driver circuit having low power consumption. A first embodiment of the source driver circuit including a data inputs which connect to sample registers. An N-bit shift register containing N is the uniquely addressable channels couples to the sample registers. The input data is indicative of an image to be displayed on the LCD. Hold registers couple to the sample registers to store the sampled data. The hold register receives a transfer signal to determine when the data from the sample register should be transferred to the hold register. A resister string can provide up to 64 voltage levels for example which couple to a set of decoder cells that are programmable to decode the input data to select respective output voltage levels. Output cells couple between the hold register a set of driver outputs. A set of switches connect each respective decoder cell to the driver outputs. Both the set of switches and output cells couple to receive a mode signal, such that two modes of operation exists. In the first mode, when each switch is closed, the output cells are bypassed and, in the second mode, when each switch is open, the decoder cells are bypassed. This provides for a gray scale mode having full color display resolution and a standby mode that decreases the amount of power dissipated yet presents voltage output for the LCD to provide text, icon, graphic and video data.

In an alternative embodiment, latch circuits are employed which vary the level of voltage output during the standby mode. Thus, video displays may be programmed to have a specified resolution while still conserving power. The latch circuits may couple between the sample registers and the hold registers or between the hold registers and the output cells.

Advantages of this design include but are not limited to dual mode thin film transistor liquid crystal display source driver circuit having low power consumption.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF PREFERRED EMBODIMENTS

Figure 1:
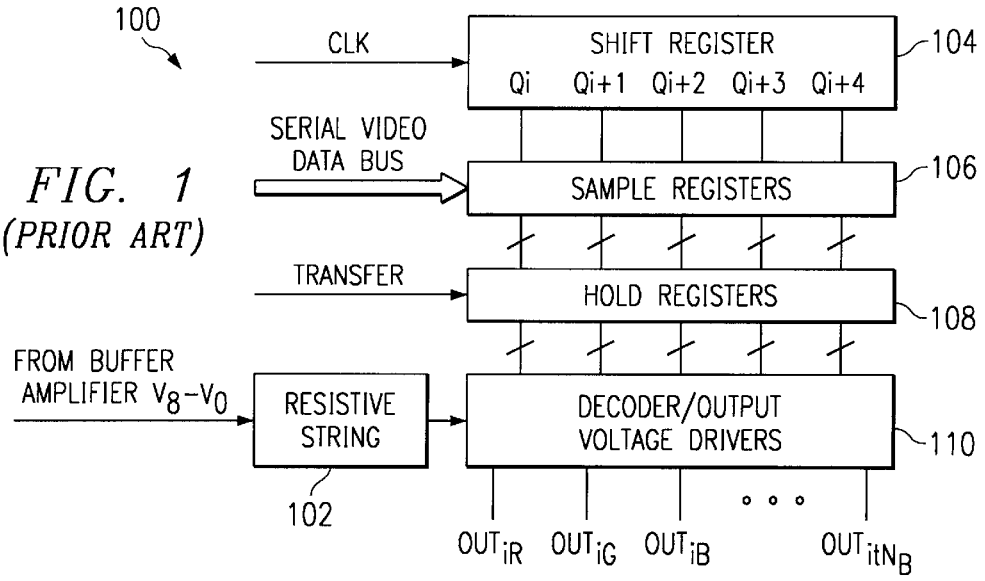
FIG. 1 (PRIOR ART)
FIG. 1 is a block diagram of a known embodiment of TFT-LCD source driver.

The present invention is best understood by comparison with the prior art. Hence this detailed description begins with a discussion of a known source driver 100 as illustrated in FIG. 1. Driver 100 includes a shift register 104 which contains an N-bit shift register, where N is the number of uniquely addressable channels within the source driver. The shift register 104 is clocked with the CLK signal. The sample registers 106 receive serial video data from the serial video data bus to store channels of six-bit display data for one line period, enabling the internal resistive digital-to-analog converter (DAC) 102 coupled to the decoder/output voltage drivers 110 to use the display data from line time x while the next line of data (from line time x+1) is loaded into the sample registers 106. The contents of the sample registers 106 are transferred to the hold registers 108 before being over-written with the next line of six-bit words of display data from the serial video data bus after a low to high transition of the transfer signal occurs at the end of line x+1. An internal resistor string 102 used for voltage dividing which may comprise a string of 64 resistors, produces 64 distinct voltage levels from the 9 voltage reference inputs. Linear voltage levels are generated between each pair of adjacent reference voltage inputs, utilizing the string of resistors between the reference voltages. Decoder/output voltage drivers 110 select the desired output voltage based upon the data in the hold register 108 for each of the channels. As the display data for line x+1 is loaded into the sample registers 106, decoder/output voltage drivers 110 use the data for line x stored in the hold registers 108. Each of the output voltage drivers 110 outputs one of the 64 analog voltages based upon the corresponding decode of the display data.

Figure 6:
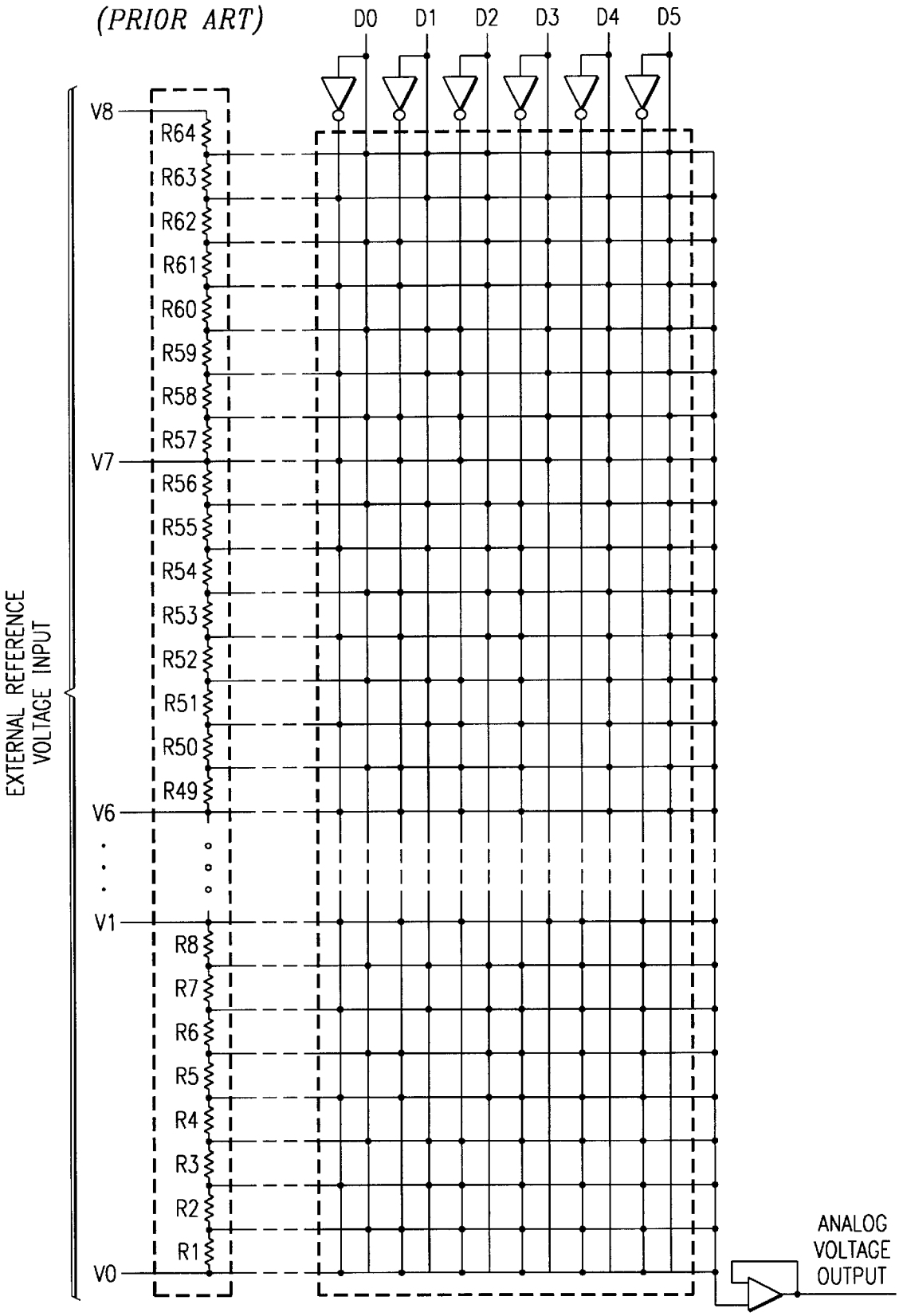
FIG. 6 (PRIOR ART)
FIG. 6 is a circuit diagram of a resistive string voltage reference coupled to a ROM decoder output buffer cell.

A detailed schematic of a known ROM decoder connect to a internal resistive DAC 102 may be found in FIG. 6. As illustrated 8 reference voltages supplied across 64 resistors provide the voltage levels necessary for the ROM decoder to decode the six-bit data supplied from hold register 108, where each '●' represents a transistor.

Figure 2:
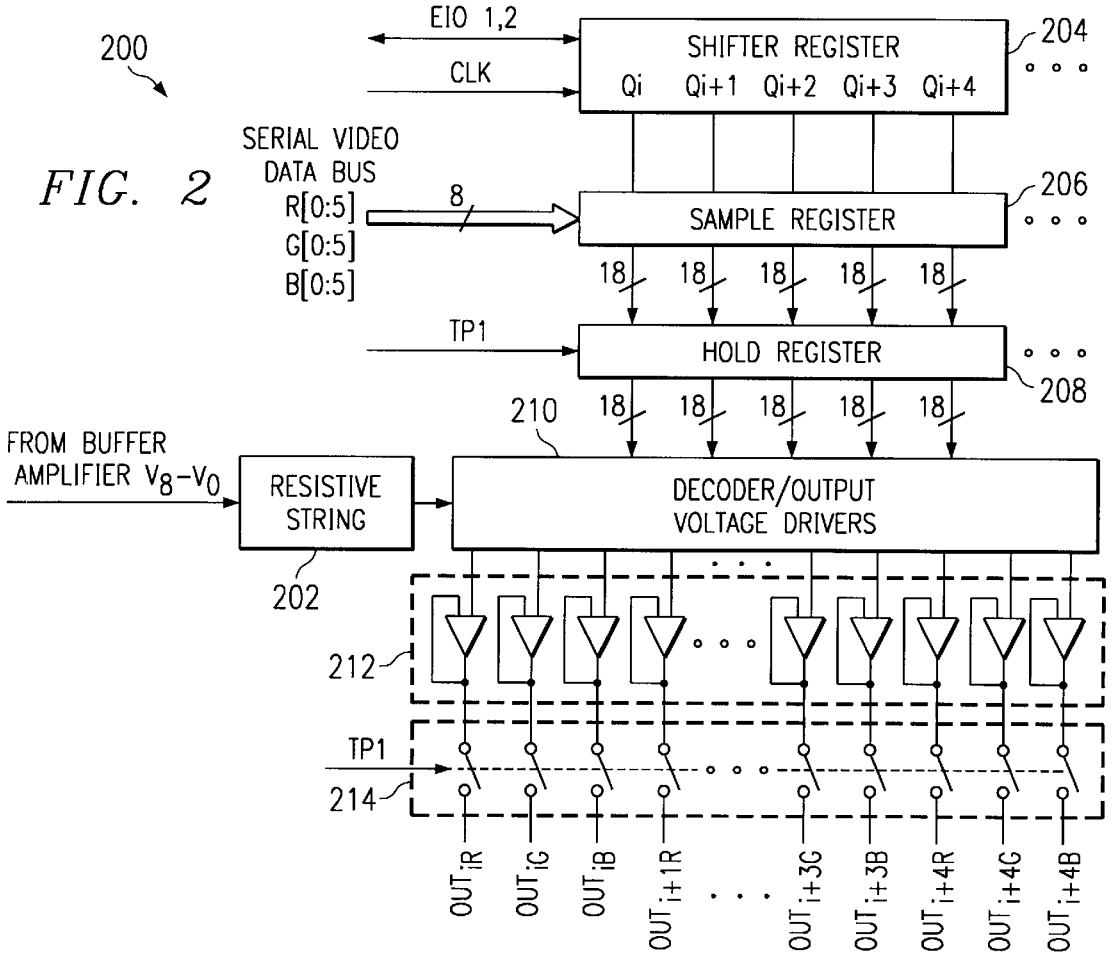
FIG. 2 is a block diagram of a first embodiment of a dual mode TFT-LCD source driver circuit in the gray scale mode in accordance with the present invention.

FIG. 2 displays a source driver circuit 200 in accordance with the present invention as it operates in the gray scale mode. Driver 200 includes a shift register 204 which contains an N-bit shift register, where N is the number of uniquely addressable channels within the source driver. The shift register 204 is clocked with the CLK signal. The sample registers 206 receive serial video data from the serial video data bus to store channels of six-bit display data for one line period, enabling the internal resistive digital-to-analog converter (DAC) 202 coupled to the decoder/output voltage drivers 210 to use the display data from line time x while the next line of data (from line time x+1) is loaded into the sample registers 206. The contents of the sample registers 206 are transferred to the hold registers 208 before being over-written with the next line of six-bit words of display data from the serial video data bus after a low to high transition of the transfer signal occurs at the end of line x+1. An internal resistor string 202 used for voltage dividing which may comprise a string of 64 resistors, produces 64 distinct voltage levels from the 9 voltage reference inputs. Linear voltage levels are generated between each pair of adjacent reference voltage inputs, utilizing the string of resistors 202 between the reference voltages. Decoder/output voltage drivers 210 select the desired output voltage based upon the data in the hold register 208 for each of the channels. As the display data for line x+1 is loaded into the sample registers 206, decoder/output voltage drivers 210 use the data for line x stored in the hold registers 208. Each of the output voltage drivers 210 outputs one of the 64 analog voltages to output buffers 212 based upon the corresponding decode of the display data. Switches 214 are closed during gray scale mode to enable the full color resolution voltage levels to be provided at the LCD.

Figure 3:
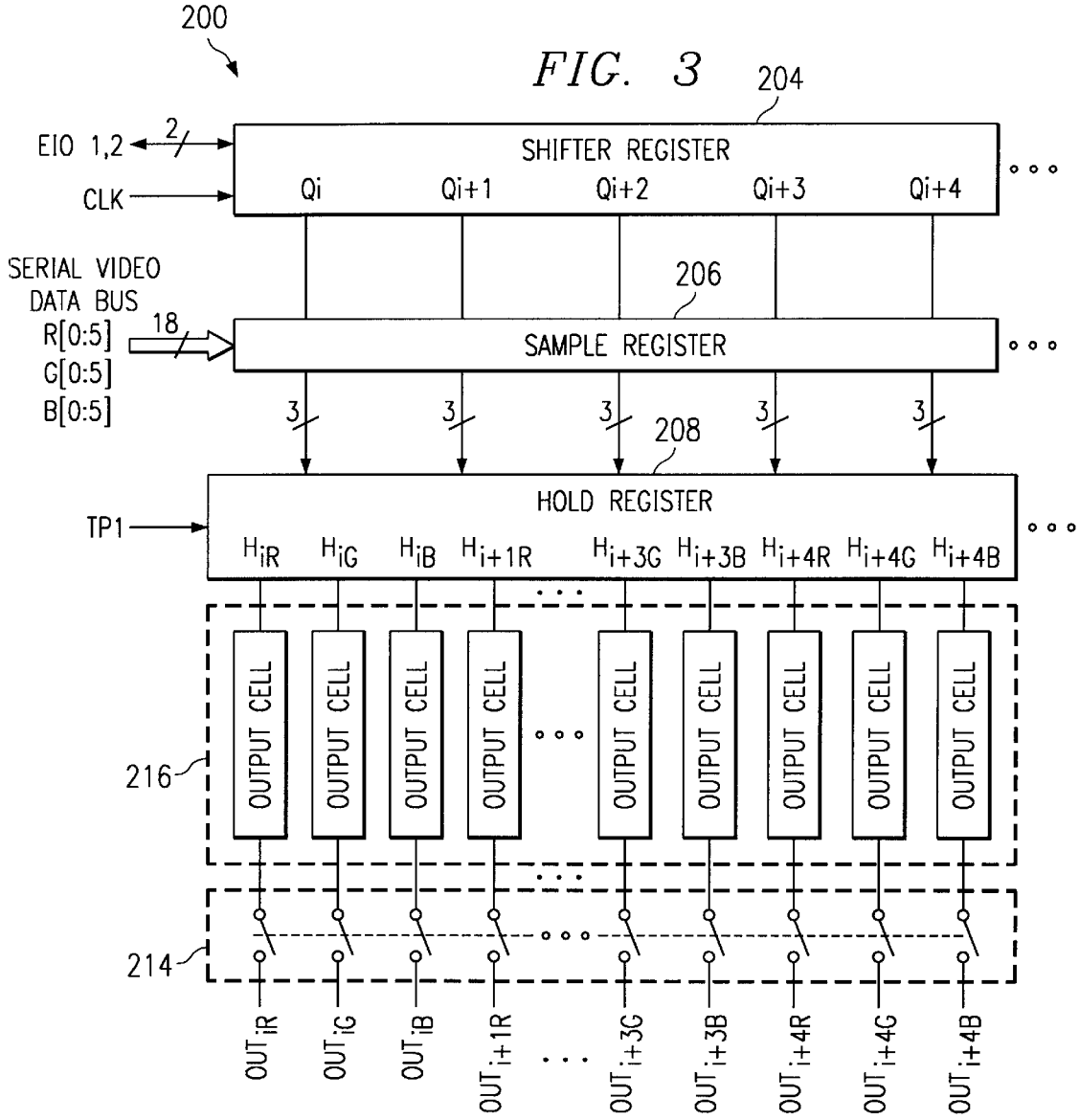
FIG. 3 is a block diagram of a first embodiment of a dual mode TFT-LCD source driver circuit in the standby mode in accordance with the present invention.
Figure 4:
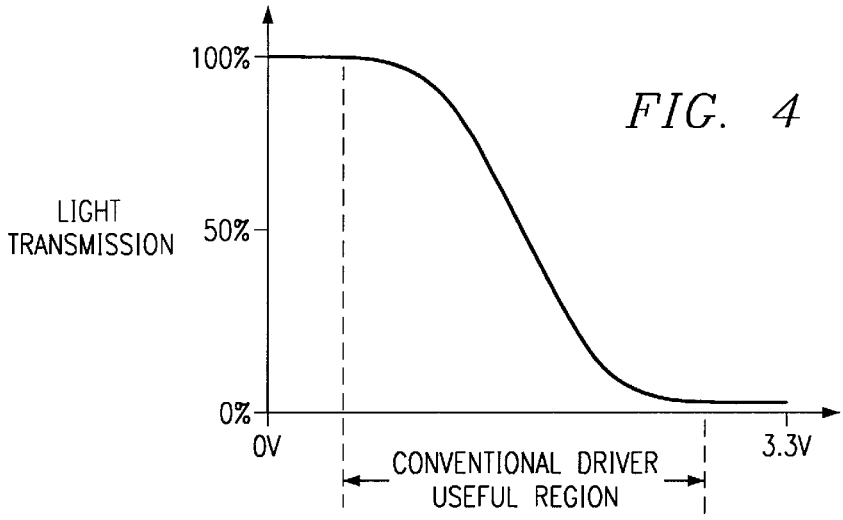
FIG. 4 is a voltage vs. light transmission diagram of the TFT-LCD source driver of FIG. 1.

FIG. 3 displays a source driver circuit 200 in accordance with the present invention as it operates in the standby mode. Driver 200 includes a shift register 204 which contains an N-bit shift register, where N is the number of uniquely addressable channels within the source driver. The shift register 204 is clocked with the CLK signal. The sample registers 206 receive serial video data from the serial video data bus to store channels of six-bit display data for one line period, enabling the hold registers 208 to hold three-bit display data from line time x while the next line of data (from line time x+1) is loaded into the sample registers 206. The contents of the sample registers 206 are transferred to the hold registers 208 before being over-written with the next line of six-bit words of display data from the serial video data bus after a low to high transition of the transfer signal occurs at the end of line x+1. Output cells 216 produces distinct voltage levels using 2 reference voltage reference inputs, a mode signal and data transferred by hold register 208. Switches 214 are open during standby mode to power down the resistive string 202, decoder/output voltage drivers 210 and buffers 212.

Figure 7:
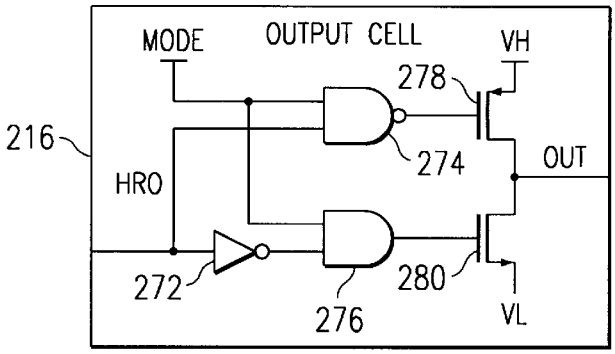
FIG. 7 is a schematic of the output cell of FIGS. 3, 8, and 12.

FIG. 7 illustrates output cell 216 of FIGS. 2 and 3. The one-bit data signal HRO from each respective hold register connects to inverter 272 and NAND gate 274. The mode signal MODE couples to the NAND gate 274 and AND gate 276. NAND gate 274 connects to transistor 278 which is coupled between the output OUT and power supply VH. AND gate 276 connects to transistor 280 which couples between the output OUT and power supply rail VL. In operation, during gray scale mode the output is kept at high impedance. This occurs when the mode signal MODE is low. During standby mode, when the mode signal is high, voltage VL is provided at output OUT when the active bit of the hold register 208 is low. In the alternative, when the active bit of the hold register 208 is high, voltage VH is provided at the output OUT.

Figure 5:
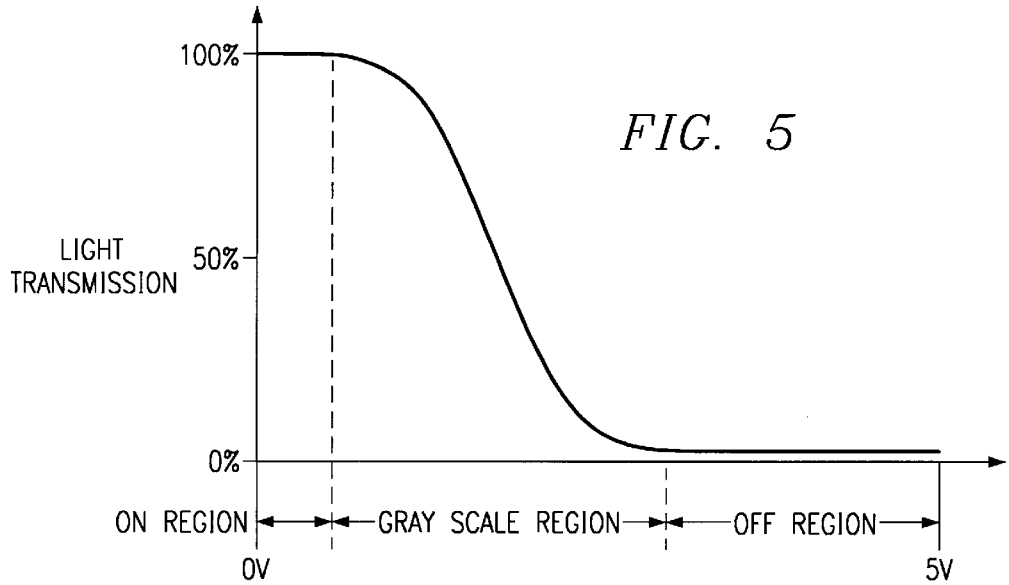
FIG. 5 is a voltage vs. light transmission diagram of the dual mode TFT-LCD source driver of FIG. 2.

In accordance with the present invention in FIGS. 2 and 3, a TFT-LCD source driver circuit for driving source signal line of a liquid crystal display panel includes two driving modes: gray scale mode and monochrome mode. Gray scale modes applies selected voltage to source signal line. The selected voltage proportion to liquid crystal light transmission factor. Standby mode applies only two voltage levels to source signal line which drives the liquid crystal light transmission factor on 100% or 0% as shown in FIG. 5.

There is a mode signal to select between gray scale mode and standby mode. In standby mode, digital to analog converter portion and output circuit is shut down. In addition, most of registers and latches are shut down as well. Only one bit of the register and latch data for each output channel is left operable. Thus, the line data connects to output stage from line register directly. Major power consumption portions are shutdown such that only the digital circuits are active. Logic gate transaction frequency and data line charge and discharge current of the sample register 206, hold register 208 and output cell 216 may be used determine the source driver's total power consumption.

In order to save TFT-LCD power consumption, source driver in accordance with the present invention provides both a full color display (gray scale) mode and a standby display modes. With this solution, TFT-LCD could provide both full color and low power consumption for handheld or communication application i.e. PDA or mobile phone. During most of the time that the handheld communication device is in use, the device will be in standby mode which provides 8 colors at display quality (resolution in pixels). This mode is of substantial quality to display text and icons. When the need arises to display a video or more colors within an image, the TFT-LCD can switch to gray scale mode which provides more colors (i.e. 64 gray scale source driver produce 262144 colors). The TFT-LCD source driver in accordance with the present invention not only provides colors of display quality, but also saves power consumption in the monochrome and gray scale modes.

Signal driver circuit 200 shown in FIGS. 2 and 3 provides up to sixty four voltage levels on each of two hundred one LCD columns. It will be recognized, though that more or less voltages or columns may be utilized. Within signal driver 200, decoder/output voltage drivers 24 are used to provide a specific voltage output to each column.

As shown in FIG. 3, the added switches 214 shut-down the analog circuits in the standby mode. The first power down mode includes powering down the internal resistive digital-to-analog converter (DAC) 202 where there will be no gamma reference voltage; thus, no power consumption. The second power down mode includes powering down the output buffer amplifiers 212 where the switches 214 control the switching of modes whether standby or gray scale. In standby mode, the two output transistors (not shown) may function as switches to control using a single bit of data to the driver output two different voltage levels. Such that the TFT-LCD displays only 100% brightness for the red, green and blue pixels.

Figure 8:
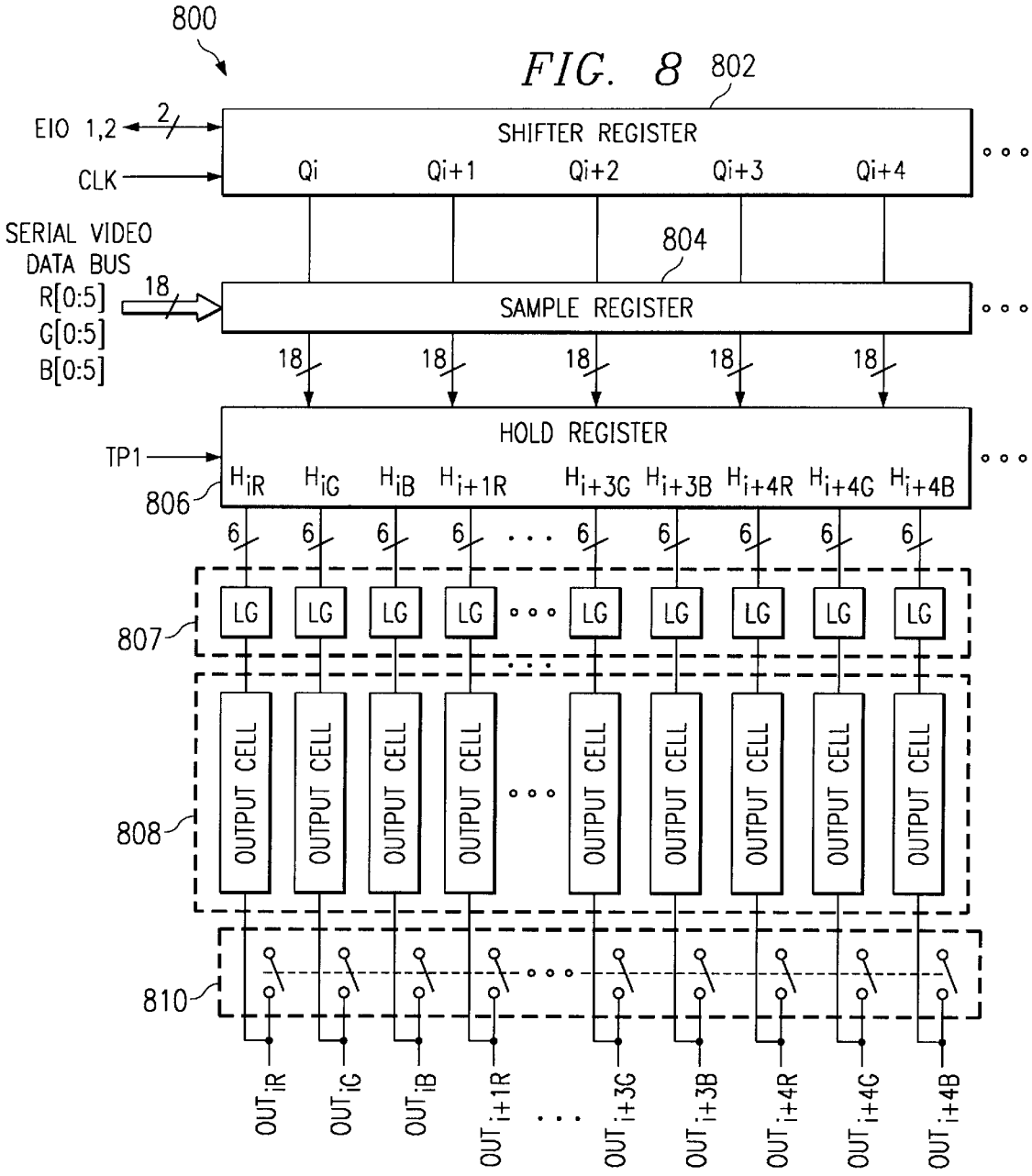
FIG. 8 is a block diagram of a second embodiment of a dual mode TFT-LCD source driver circuit in the gray scale mode in accordance with the present invention.

FIG. 8 represents the standby mode of a second embodiment of a driver circuit 800 in accordance with the present invention. Driver 800 includes a shift register 802 which contains an N-bit shift register, where N is the number of uniquely addressable channels within the source driver 800. The shift register 802 is clocked with the CLK signal. The sample registers 804 receive serial video data from the serial video data bus to store channels of six-bit display data for one line period, enabling the hold registers 806 to hold three-bit display data from line time x while the next line of data (from line time x+1) is loaded into the sample registers 804. The contents of the sample registers 804 are transferred to the hold registers 806 before being over-written with the next line of six-bit words of display data from the serial video data bus after a low to high transition of the transfer signal occurs at the end of line x+1. Programmable latch circuits 807 couple between each respective hold register 806 and output cell 808 to decipher from the six-bit data transferred from hold register 807 and provide a one-bit signal to the output cell 808. Output cells 808 produces distinct voltage levels using 2 reference voltage reference inputs, a mode signal and data transferred by latch circuit 807. Switches 810 are open during standby mode to power down the resistive string, decoder/output voltage drivers and output buffers (not shown).

Figure 9:
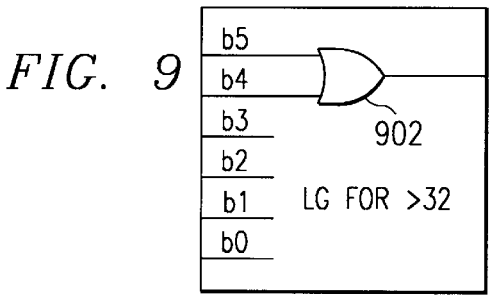
FIG. 9 is a schematic of a first embodiment of the latch circuit of FIGS. 8, and 12.
Figure 10:
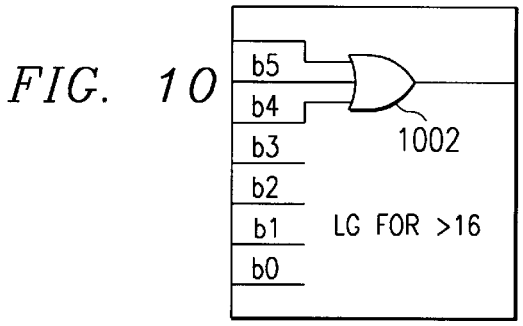
FIG. 10 is a schematic of a second embodiment of the latch circuit of FIGS. 8 and 12.
Figure 11:
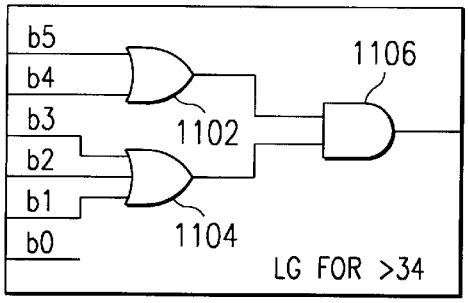
FIG. 11 is a schematic of a third embodiment of the latch circuit of FIGS. 8, and 12.

FIGS. 9, 10 and 11 illustrate a variety of ways in which the latch circuit 807 of FIG. 8 may be implemented. Specifically, in FIG. 9, OR gate 902 only provides the two most significant bits of six-bit data bit as output. Thus, pixel dot data corresponding to 16 and above will be represented at the LCD. In FIG. 10, OR gate 1002 only provides the three most significant bits of six-bit data bit as output. Thus, pixel dot data corresponding to 8 and above will be represented at the LCD. Moreover, in FIG. 11, AND gate 1106 and OR gates 1102 and 1104 only provides the four most significant bits of six-bit data bit as output. Thus, pixel dot data corresponding to 4 and above will be represented at the LCD.

Figure 12:
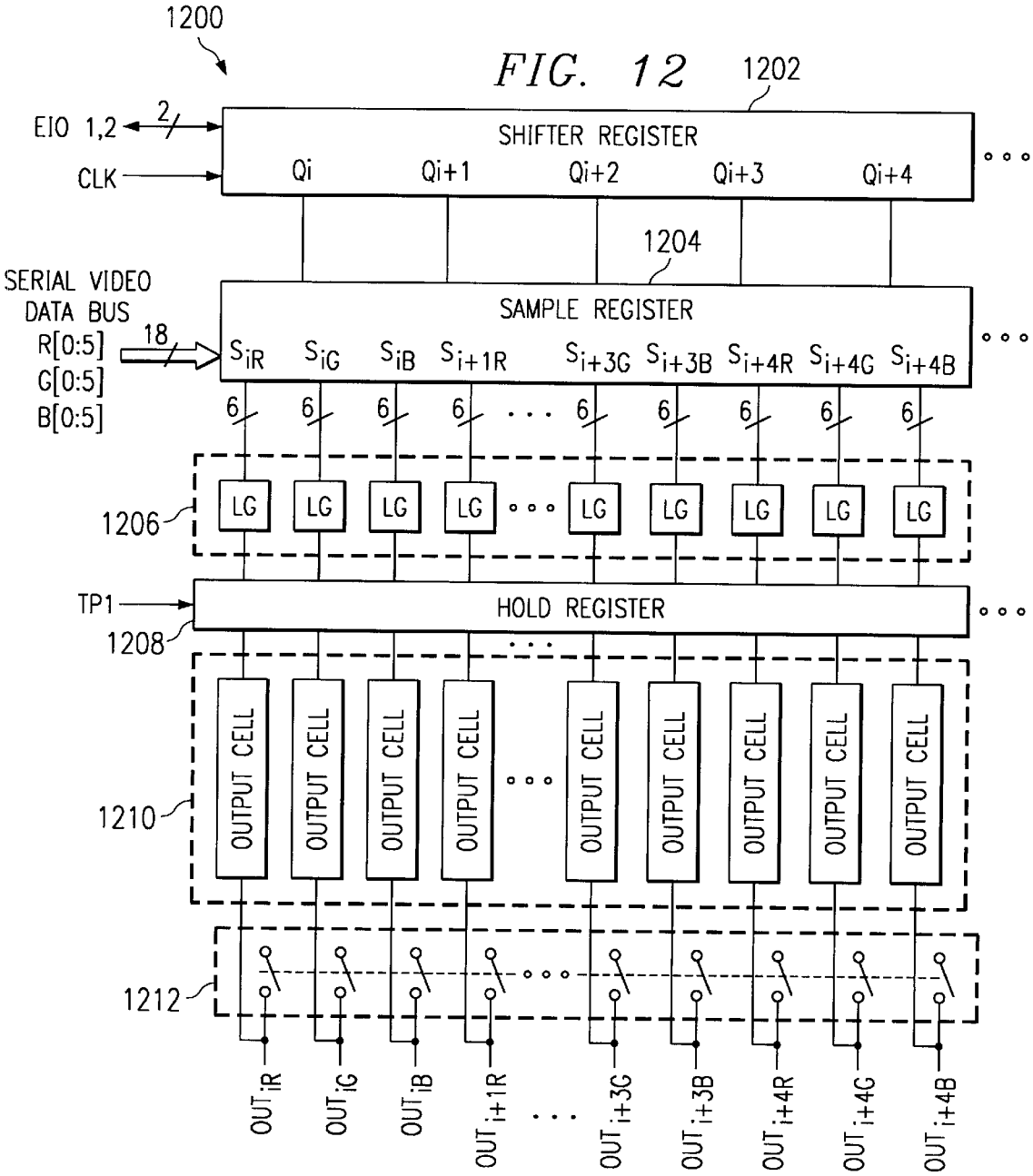
FIG. 12 is a block diagram of a third embodiment of a dual mode TFT-LCD source driver circuit in the gray scale mode in accordance with the present invention.

FIG. 12 represents the standby mode of a third embodiment of a driver circuit 1200 in accordance with the present invention. Driver 1200 includes a shift register 1202 which contains an N-bit shift register, where N is the number of uniquely addressable channels within the source driver 1200. The shift register 1202 is clocked with the CLK signal. The sample registers 1204 receive serial video data from the serial video data bus to store channels of six-bit display data for one line period, enabling the programmable latch circuits 1206 to decipher from the six-bit data transferred from sample register 1204 and provide a one-bit signal to the hold register 1208. Hold registers 1208 will hold the one-bit display data from line time x while the next line of data (from line time x+1) is loaded into the sample registers 1204. The contents of the sample registers 1204 are transferred through the latch circuits 1206 to the hold registers 1208 before being over-written with the next line of six-bit words of display data from the serial video data bus after a low to high transition of the transfer signal occurs at the end of line x+1. Output cells 1210 receive the one-bit data from hold register 1208 and produces distinct voltage levels using 2 reference voltage reference inputs, a mode signal and data transferred by hold register 1208. Switches 810 are open during standby mode to power down the resistive string, decoder/output voltage drivers and output buffers (not shown).

The present invention finds application in video systems including digital still cameras, digital video cameras, digital video processing systems.

The reader's attention is directed to all papers and documents which are filed concurrently with this specification and which are open to public inspection with this specification, and the contents of all such papers and documents are incorporated herein by reference.

All the features disclosed in this specification (including any accompany claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A dual mode source driver circuit for driving an LCD panel having reference voltages having low power consumption, comprising:

a shift register having a plurality of N addressable channels;

a plurality of data inputs connected to the source driver circuit for receiving input data indicative of an image to be displayed on the LCD, the input data being at a first digital input voltage level;

a plurality of sample registers coupled to the shift register, each sample register coupled to a corresponding one of the plurality of data inputs to receive the input data;

a plurality of hold registers, each hold register coupled to a corresponding one of the plurality of sample registers to receive the sampled input data, the plurality of hold registers coupled to receive a transfer signal wherein the transfer signal determines the timing for the transfer of sampled input data from each sample register to each respective hold register;

an internal resistive digital to analog circuit to produce linear voltage levels between any pair of adjacent reference voltages;

a plurality of decoder cells, each decoder cell coupled to the internal resistive digital to analog circuit and each respective hold register such that each decoder cell is programmable to decode the input data to select respective output voltage levels;

a plurality of output cells coupled to receive a mode signal to activate each output cell, each output cell coupled to receive the held input data from each respective hold register, wherein each of the plurality of output cells comprises, an inverter coupled to receive the input data, an AND gate coupled to the inverter and coupled to receive the mode signal, an NAND gate coupled to receive the input data and the mode signal, a P-type transistor, having a drain, a source, and a gate, the gate coupled to the NAND gate, the source coupled to a high voltage supply, the drain coupled to the output of the output cell, and a n-type transistor, having a drain, a source, and a gate, the gate coupled to the AND gate, the source coupled to a low voltage supply, the drain coupled to the output of the output cell;

a plurality of switches coupled to receive a mode signal to activate each switch, each switch connected to each of the decoder cells for switching between a gray scale mode, having full color display resolution, and a standby mode of operation that decreases the amount of power dissipated and having a voltage output for the LCD sufficient to provide text, icon, graphic and video data, wherein, in the first mode, when each switch is closed, the output cells are bypassed and, in the second mode, when each switch is open, the decoder cells are bypassed; and a plurality of driver outputs coupled to the plurality of output cells and the plurality of switches to receive each respective output voltage level for providing drive voltages derived from said input data to the LCD panel.

2. The source driver circuit as recited in claim 1, further comprising:

a plurality of latch circuits coupled to receive the mode signal, each latch circuit coupled to each respective hold register for providing programmable level of the data held in each respective hold register to each respective decoder cell when in the standby mode of operation, wherein, in the standby mode of operation, one bit of input data is transferred to each respective output cell.

3. The source driver circuit as recited in claim 1, further comprising:

a plurality of latch circuits coupled to receive the mode signal, each latch circuit coupled to each respective sample register for providing programmable level of the data to each respective hold register when in the standby mode of operation, wherein, in the standby mode of operation, one bit of input data is transferred to each respective hold register and one bit of input data is transferred to each respective output cell.

4. The source driver circuit as recited in claim 2, wherein each of the plurality of latch circuits includes a two input OR gate coupled to receive two of the most significant bits of the data from the respective hold register.

5. The source driver circuit as recited in claim 2, wherein each of the plurality of latch circuits includes a three input OR gate coupled to receive three of the most significant bits of the data from the respective hold register.

6. The source driver circuit as recited in claim 2, wherein each of the plurality of latch circuits, comprises:

a two input OR gate coupled to receive two bits of the most significant bits of the data from the respective hold register;

a three input OR gate coupled to receive the next three bits of the most significant bits of the data from the respective hold register; and a two input AND gate coupled to the two input OR gate and the three input OR gate.

7. The source driver circuit as recited in claim 3, wherein each of the plurality of latch circuits includes a two output OR gate coupled to receive two of the most significant bits of the data from the respective hold register.

8. The source driver circuit as recited in claim 3, wherein each of the plurality of latch circuits includes a three input OR gate coupled to receive three of the most significant bits of the data from the respective hold register.

9. The source driver circuit as recited in claim 3, wherein each of the plurality of latch circuits, comprises:

a two input OR gate coupled to receive two bits of the most significant bits of the data from the respective hold register;

a three input OR gate coupled to receive the next three bits of the most significant bits of the data from the respective hold register; and a two input AND gate coupled to the two input OR gate and the three input OR gate.

10. A dual mode source driver circuit for driving an LCD panel having reference voltages having low power consumption, comprising:

a shift register having a plurality of N addressable channels;

a plurality of data inputs connected to the source driver circuit for receiving input data indicative of an image to be displayed on the LCD, the input data being at a first digital input voltage level;

a plurality of sample registers coupled to the shift register, each sample register coupled to a corresponding one of the plurality of data inputs to receive the input data;

a plurality of hold registers, each hold register coupled to a corresponding one of the plurality of sample registers to receive the sampled input data, the plurality of hold registers coupled to receive a transfer signal wherein the transfer signal determines the timing for the transfer of sampled input data from each sample register to each respective hold register;

a internal resistive digital to analog circuit to produce linear voltage levels between any pair of adjacent reference voltages;

a plurality of decoder cells, each decoder cell coupled to the internal resistive digital to analog circuit and each respective hold register such that each decoder cell is programmable to decode the input data to select respective output voltage levels;

a plurality of output buffers coupled to receive a mode signal to activate each output buffer, each output buffer coupled to receive the held input data from each respective hold register;

a plurality of switches coupled to receive a mode signal to activate each switch, each switch connected to each of the decoder cells for switching between a gray scale mode, having full color display resolution, and a standby mode of operation that decreases the amount of power dissipated and having a voltage output for the LCD sufficient to provide text, icon, graphic and video data, wherein, in the first mode, when each switch is closed, the output buffers are bypassed and, in the second mode, when each switch is open, the decoder cells are bypassed; and a plurality of driver outputs coupled to the plurality of output buffers and the plurality of switches to receive each respective output voltage level for providing drive voltages derived from said input data to the LCD panel.

* * * * *